US008548361B2

(12) United States Patent
Noguchi et al.

(10) Patent No.: US 8,548,361 B2
(45) Date of Patent: Oct. 1, 2013

(54) DEVELOPING DEVICE

(75) Inventors: Akihiro Noguchi, Toride (JP); Katsuya Nose, Matsudo (JP); Kyosuke Takahashi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 122 days.

(21) Appl. No.: 13/274,459

(22) Filed: Oct. 17, 2011

(65) Prior Publication Data

US 2013/0016998 A1 Jan. 17, 2013

(30) Foreign Application Priority Data

Jul. 11, 2011 (JP) ..... 2011-152831

(51) Int. Cl.
*G03G 15/08* (2006.01)

(52) U.S. Cl.
USPC ..... 399/254; 399/119

(58) Field of Classification Search
USPC ..... 399/119, 254–256
See application file for complete search history.

(56) References Cited

U.S. PATENT DOCUMENTS

| | | | |
|---|---|---|---|
| 4,498,246 | A | 2/1985 | Cantu et al. |
| 7,010,253 | B2 | 3/2006 | Kakimoto |
| 7,263,318 | B2 | 8/2007 | Nishihama et al. |
| 7,277,649 | B2 | 10/2007 | Hirobe et al. |
| 7,349,653 | B2 | 3/2008 | Nishihama et al. |
| 7,362,989 | B2 | 4/2008 | Nishihama et al. |
| 7,386,261 | B2 | 6/2008 | Noguchi et al. |
| 7,421,226 | B2 | 9/2008 | Suenami et al. |
| 7,630,670 | B2 | 12/2009 | Nishihama et al. |
| 7,664,435 | B2 | 2/2010 | Nose |
| 7,881,638 | B2 | 2/2011 | Noguchi et al. |
| 2004/0136755 | A1 | 7/2004 | Kakimoto |
| 2006/0257162 | A1 | 11/2006 | Suenami et al. |
| 2011/0052220 | A1 | 3/2011 | Nose |
| 2011/0150525 | A1* | 6/2011 | Fujiwara et al. ..... 399/111 |

FOREIGN PATENT DOCUMENTS

| | | | |
|---|---|---|---|
| JP | 9-319223 | A | 12/1997 |
| JP | 10-31363 | A | 2/1998 |
| JP | 11-52731 | A | 2/1999 |
| JP | 2003-57929 | A | 2/2003 |
| JP | 2004-191469 | A | 7/2004 |
| JP | 2006-317564 | A | 11/2006 |
| JP | 2007-304141 | A | 11/2007 |
| JP | 2008-116723 | A | 5/2008 |
| JP | 2009-151103 | A | 7/2009 |

* cited by examiner

*Primary Examiner* — Hoang Ngo
(74) *Attorney, Agent, or Firm* — Fitzpatrick, Cella, Harper & Scinto

(57) ABSTRACT

A developing device includes a developer carrying member for carrying a developer; a first feeding portion for supplying the developer to the developer carrying member while feeding the developer along the developer carrying member; a second feeding portion, communicating with the first feeding portion at end portions thereof, for feeding the developer in a direction opposite to a developer feeding direction of the first feeding portion while collecting the developer from the developer carrying member; and a partition wall portion for partitioning the first and second feeding portions. The partition wall portion includes an opposing portion opposing the developer carrying member with a spacing. A surface roughness of at least the opposing portion is larger than that of the developer carrying member.

7 Claims, 8 Drawing Sheets

(a)

(b)

(a)

(b)

DEVELOPING DEVICE

FIELD OF THE INVENTION AND RELATED ART

The present invention relates to a developing device of a function separation type in which a developer is supplied from a first feeding portion to a developer carrying member and then is collected from the developer carrying member to a second feeding portion. Specifically, the present invention relates to a structure for preventing a carry-around (carry-over or entrainment) phenomenon of the developer collected to the second feeding portion with rotation of first developer carrying member.

An image forming apparatus in which an electrostatic image formed on an image bearing member is developed with a toner into a toner image by supplying the toner from a developing device to the electrostatic image, and the toner image carried on the image bearing member is transferred onto a recording material directly or via an intermediary transfer member and then the recording material on which the toner image is transferred is heated and pressed to fix an image on the recording material has been widely used.

The function separation-type developing device in which a first feeding portion and a second feeding portion are provided in parallel in a developing container to circulate the developer, and the developer is supplied from the first feeding portion to the developer carrying member and is, after being subjected to development, collected from the developer carrying member to the second feeding portion has been put into practical use (Japanese Laid-Open Patent Application (JP-A) 2004-191469).

As shown in FIG. 2, in the function separation-type developing device, the developer is by-passed from the first feeding portion (41*a*) to the second feeding portion (41*b*) via the developer carrying member. For this reason, as shown in FIG. 3, at the first feeding portion (41*a*), the developer fed from an upstream side toward a downstream side is gradually decreased in amount. On the other hand, at the second feeding portion (41*b*), the collected developer is merged to be gradually increased in amount from the upstream side toward the downstream side. As a result, when the developer is deteriorated and lowered in flowability, a phenomenon that a height of the developer surface is increased in a downstream region of the second feeding portion and the developer collected to the second feeding portion is carried around by the developer carrying member (44) is liable to occur. When the collected developer with less toner content is coated again onto the developer carrying member (44) and is used for the development, at a position corresponding to the downstream side of the second feeding portion, compared with the upstream side, a developing efficiency is lowered and thus a density of the image developed from the electrostatic image tends to be lowered.

In JP-A 2009-151103, in order to address such a problem, as shown in FIG. 2, a preventing member (101) opposing the developer carrying member (44) with a spacing is provided on a partition wall (41*c*) for partitioning the first feeding portion (41*a*) and the second feeding portion (41*b*). The developer carried around by the developer carrying member (44) is caught by the preventing member (101) to form a pseudo blade, so that the developer developed on the developer carrying member (44) is completely removed and is collected into the second feeding portion (41*b*).

Incidentally, a developing device including two developer carrying members provided in parallel to each other has also been put into practical use (JP-A 2004-191469 and JP-A 2009-151103). As shown in FIG. 10, the developer carried and used for development by a first developer carrying member (44*a*) at the first feeding portion (41*a*) is delivered to a second developer carrying member (44*b*) and then is, after being used for development, collected into the second feeding portion (41*b*).

In recent years, the developing device is downsized for realizing downsizing of the image forming apparatus, so that a diameter of the developer carrying member becomes small. On the other hand, a process speed of image formation is increased for enhancing productivity of the image forming apparatus, so that a peripheral speed of the developer carrying member is increased in order to address an increase in developing speed. As a result, it was turned out that the developer deposited on and carried around by the developer carrying member cannot be sufficiently collected by the preventing member described in JP-A 2009-151103. It was found that when the peripheral speed of the developer carrying member was increased, the developer passing through a gap between the preventing member and the developer carrying member and then being carried around by the developer carrying member was increased in proportion.

SUMMARY OF THE INVENTION

A principal object of the present invention is to provide a developing device capable of effectively preventing a carry-around phenomenon of a developer collected into a second feeding portion with rotation of a developer carrying member.

According to an aspect of the present invention is to provide a developing device comprising:

a developer carrying member for carrying a developer;

a first feeding portion for supplying the developer to the developer carrying member while feeding the developer along the developer carrying member;

a second feeding portion, communicating with the first feeding portion at end portions thereof, for feeding the developer in a direction opposite to a developer feeding direction of the first feeding portion while collecting the developer from the developer carrying member; and a partition wall portion for partitioning the first and second feeding portions, wherein the partition wall portion include an opposing portion opposing the developer carrying member with a spacing, and wherein a surface roughness of at least the opposing portion is larger than that of the developer carrying member.

According to another aspect of the present invention is to provide a developing device comprising:

a first developer carrying member for carrying a developer to develop a latent image formed on an image bearing member;

a second developer carrying member for carrying the developer, delivered from the first developer carrying member, to develop the latent image formed on the image bearing member;

a first feeding portion for supplying the developer to the first developer carrying member while feeding the developer along the first developer carrying member;

a second feeding portion, communicating with the first feeding portion at end portions thereof, for feeding the developer in a direction opposite to a developer feeding direction of the first feeding portion while collecting the developer from the second developer carrying member;

a partition wall portion for partitioning the first and second feeding portions;

a first opposing portion, provided on the partition wall portion, opposing the first developer carrying member with a spacing; and a second opposing portion, provided on the partition wall portion, opposing the second developer carrying member with a spacing, wherein a surface roughness of the first opposing portion is larger than that of the first developer carrying member, and a surface roughness of the second opposing portion is larger than that of the second developer carrying member.

These and other objects, features and advantages of the present invention will become more apparent upon a consideration of the following description of the preferred embodiments of the present invention taken in conjunction with the accompanying drawings.

Figure 5:
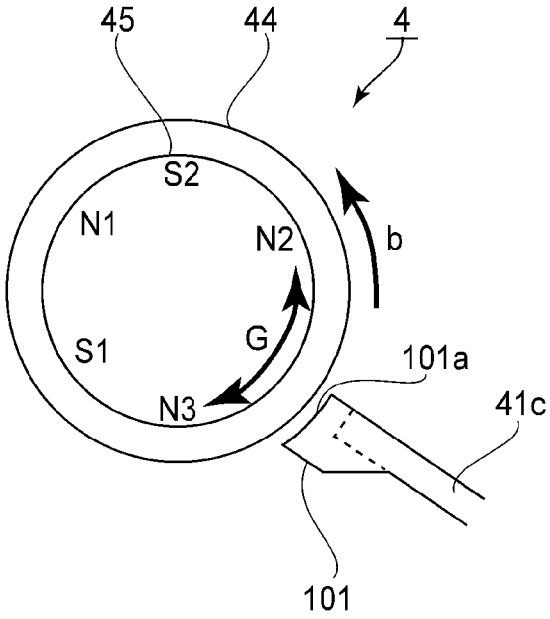
Figure 5:
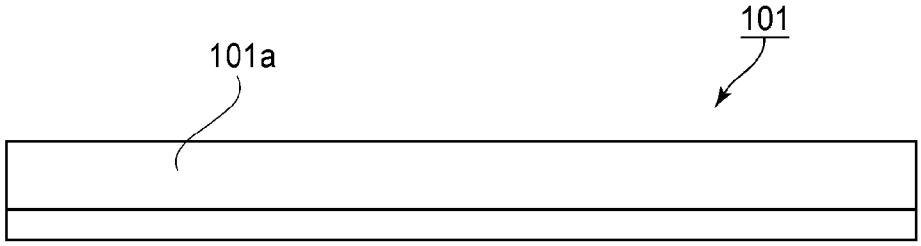

Parts (a) and (b) of FIG. 5 are illustrations of a structure of the carry-around preventing member in Embodiment 1.

Figure 6:
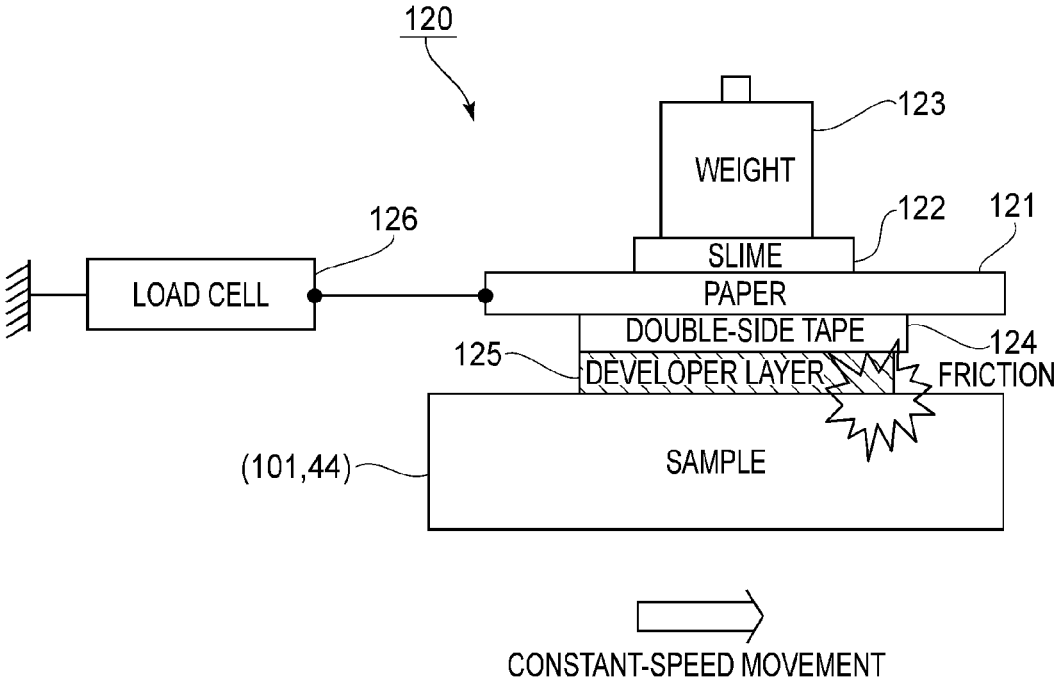

FIG. 6 is an illustration of a measuring apparatus of a coefficient of dynamic friction.

Figure 7:
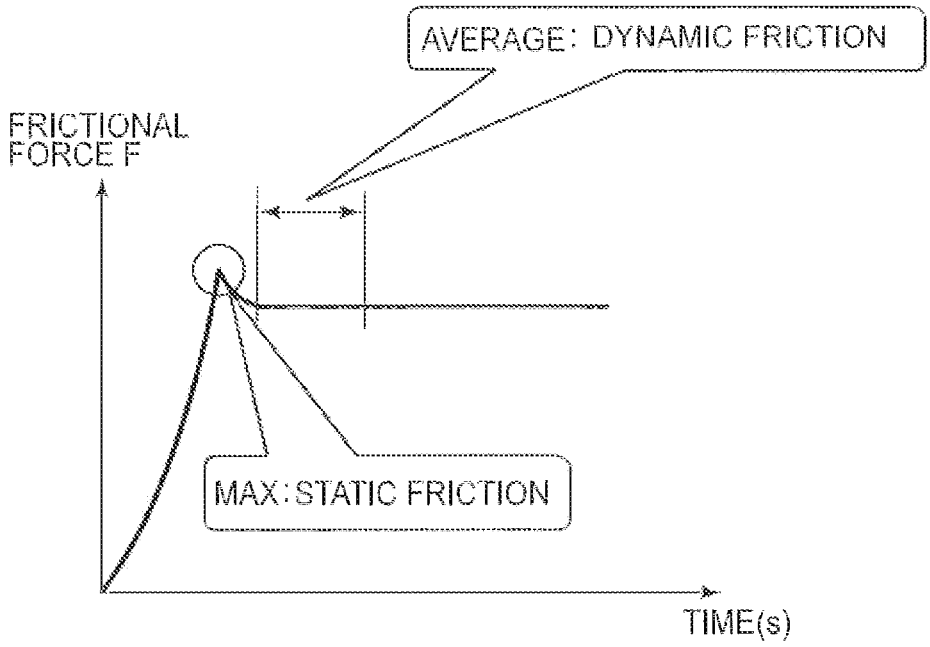

FIG. 7 is a graph for illustrating the coefficient of dynamic friction.

Figure 8:
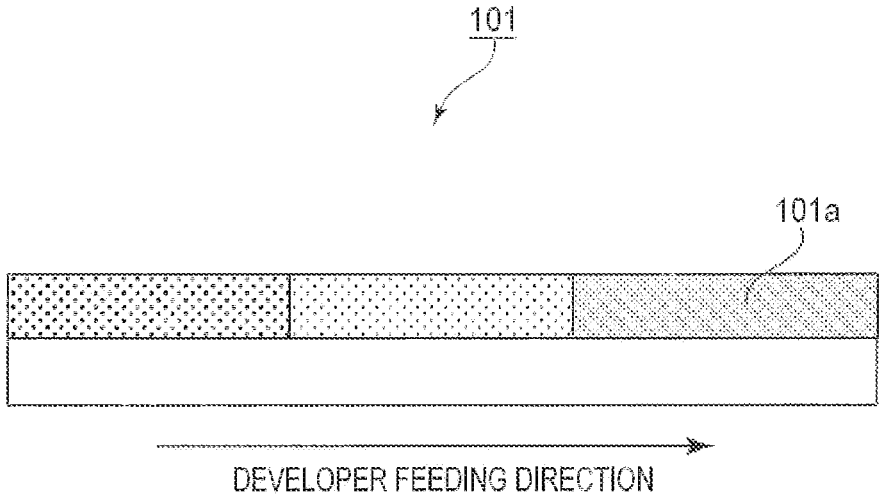

FIG. 8 is an illustration of a structure of a carry-around preventing member in Embodiment 2.

Figure 9:
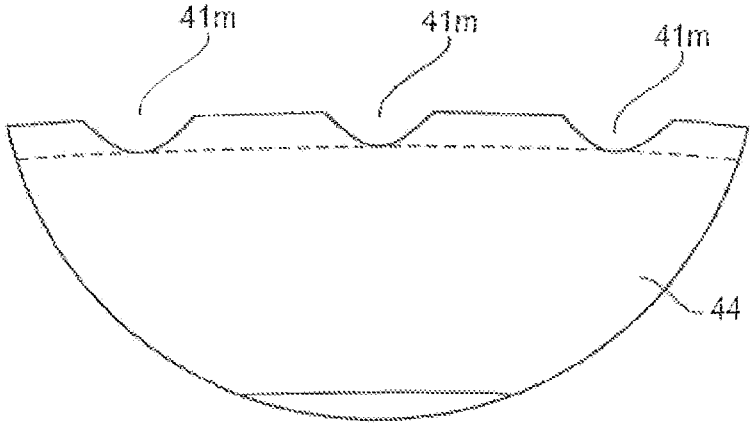

FIG. 9 is an illustration of a surface state of a developing sleeve in Embodiment 3.

Figure 10:
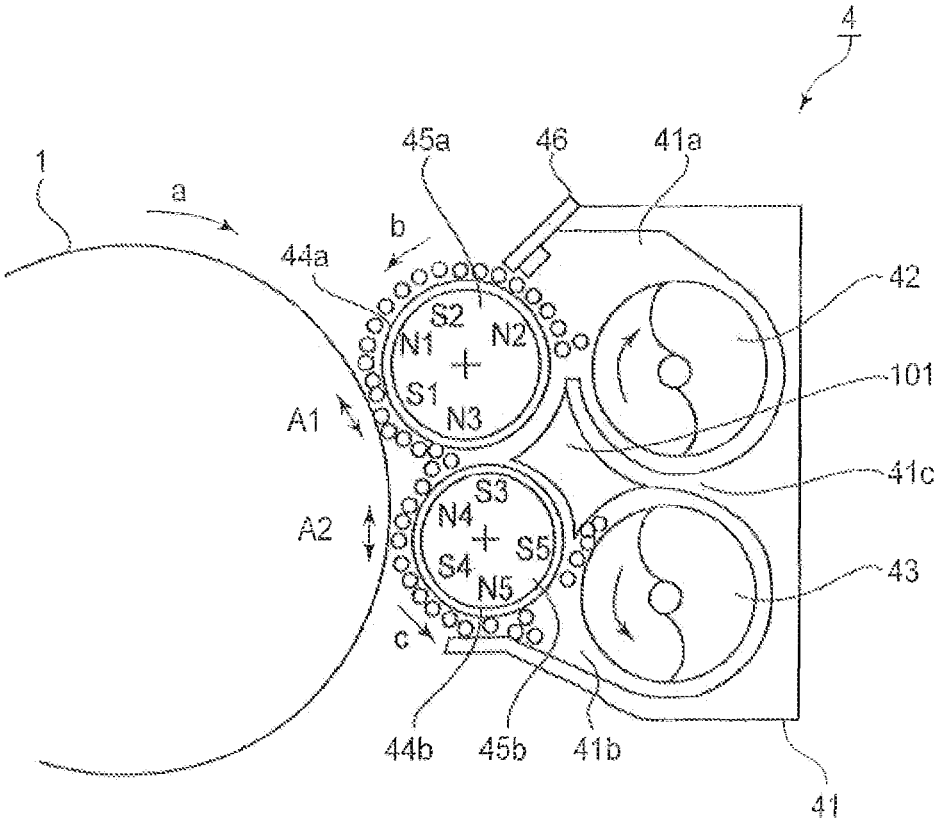

FIG. 10 is an illustration of a structure of a developing device at a cross section perpendicular to an axis of the developing device in Embodiment 4.

Figure 11:
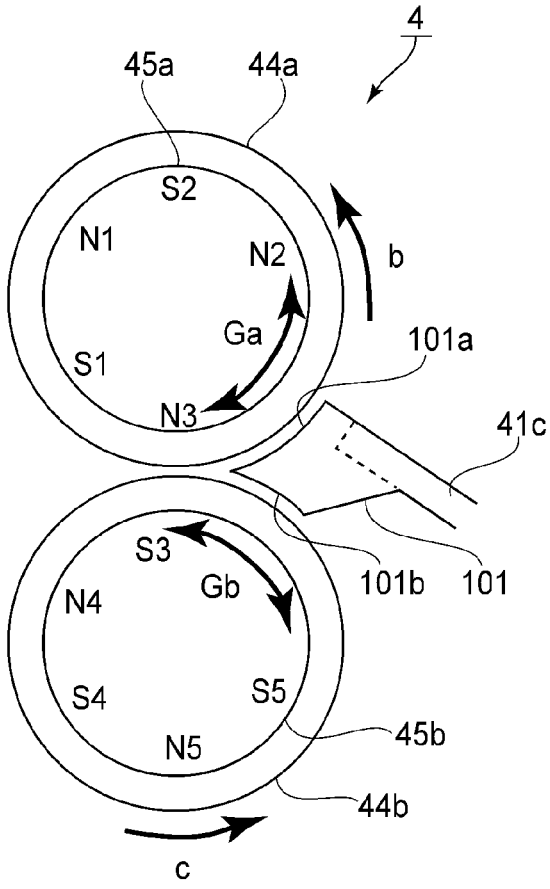
Figure 11:
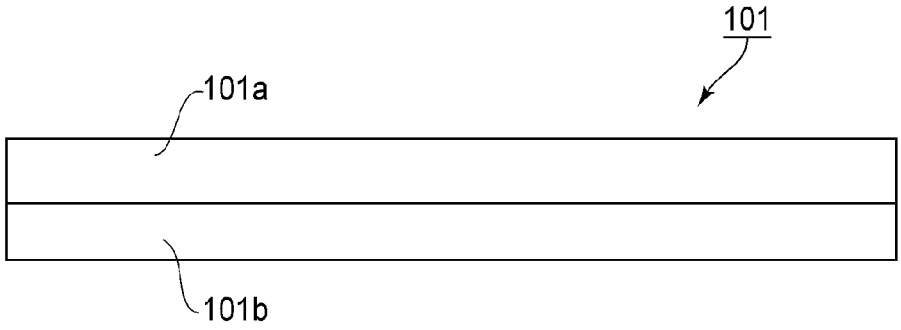

Parts (a) and (b) of FIG. 11 are illustrations of a structure of a carry-around preventing member in Embodiment 4.

DESCRIPTION OF THE PREFERRED EMBODIMENTS

Hereinbelow, embodiments of the present invention will be described with reference to the drawings. The present invention can also be carried out in other embodiments in which a part or all of constitutions of the following embodiments are replaced with alternative constitutions so long as a constraining performance at an opposing surface at which a first feeding portion and second feeding portion are separated is set at a level higher than that of a developer carrying member.

Therefore, a developing device is not limited to a vertical stirring type but can also be carried out in a horizontal stirring type so long as the developing device is of a function separation type in which a developer is supplied from the first feeding portion to the developer carrying member and then is collected from the developer carrying member into the second feeding portion. An image forming apparatus in the present invention can be carried out irrespective of full-color image formation, monochromatic image formation, a one-drum type, a tandem type, a direct transfer type, a recording material conveyance type, an intermediary transfer type, a type of a recording material, a charging type, an exposure type, a transfer type, and a fixing type. In the following embodiments, only a major part of the image forming apparatus relating to formation and transfer of the toner image will be described but the present invention can be carried out in various fields of apparatuses or machines such as printers various printing machines, copying machines, facsimile machines, and multi-function machines.

<Image Forming Apparatus>

Figure 1:
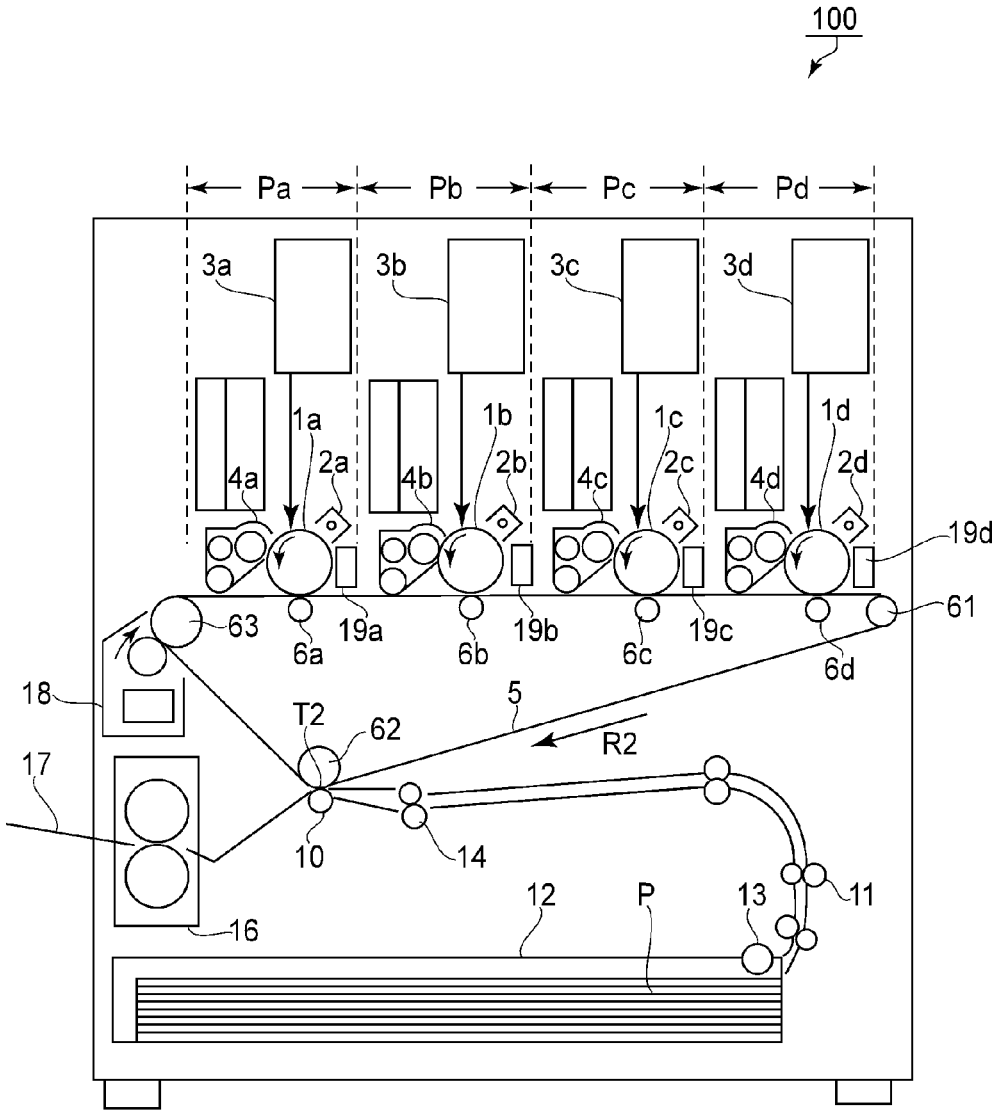
FIG. 1 is an illustration of a structure of an image forming apparatus.

FIG. 1 is an illustration of a structure of an image forming apparatus 100. As shown in FIG. 1, the image forming apparatus 100 is an intermediary transfer type full-color printer of the tandem type in which image forming portions Pa, Pb, Pc and Pd are disposed along an intermediary transfer belt 5.

At the image forming portion Pa, a yellow toner image is formed on a photosensitive drum 1*a* and then is primary-transferred onto the intermediary transfer belt 5. At the image forming portion Pb, a magenta toner image is formed on a photosensitive drum 1*b* and then is primary-transferred onto the intermediary transfer belt 5. At the image forming portions Pc and Pd, a cyan toner image and a black toner image are formed on a photosensitive drum 1*c* and a photosensitive drum 1*d*, respectively, and are primary-transferred onto the intermediary transfer belt 5.

The four color toner images transferred on the intermediary transfer belt 5 are conveyed to a secondary transfer portion T2, at which the four color toner images are collectively secondary-transferred onto a recording material P. A separating roller 13 separates the recording material P, one by one, pulled out from a recording material cassette 12 and feeds the recording material P to a registration roller 14. The registration roller 14 sends the recording material P to a secondary transfer portion T2 by timing the recording material to the toner images on the intermediary transfer belt 5. The recording material P on which the four color toner images are secondary-transferred is heated and pressed by a fixing device 16. The fixing device heats and presses the recording material P, so that the toner images are fixed on a surface of the recording material P. Thereafter, the recording material P is discharged onto a tray 17.

The image forming portions Pa, Pb, Pc and Pd have the substantially same constitution except that the colors of toners of yellow for a developing device 4*a* provided at the image forming portion Pa, of magenta for a developing device 4*b* provided at the image forming portion Pb, of cyan for a developing device 4*c* provided at the image forming portion Pc, and of black for a developing device 4*d* provided at the image forming portion Pd are different from each other. In the following description, the image forming portion Pa will be described and with respect to other image forming portions Pb, Pc and Pd, the suffix a of reference numerals (symbols) for representing constituent members (means) for the image forming portion Pa is to be read as b, c and d, respectively, for explanation of associated ones of the constituent members for the image forming portions Pb, Pc and Pd.

At the image forming portion Pa, around the photosensitive drum 1*a*, a corona charger 2*a*, an exposure device 3*a*, the developing device 4*a*, a primary transfer roller 6*a* and a drum cleaning device 19*a* are disposed. The photosensitive drum 1*a* is constituted by forming a photosensitive layer on an outer peripheral surface of an aluminum cylinder and is rotated at a predetermined process speed.

The surface of the photosensitive drum 1*a* is electrically charged uniformly to a negative-polarity potential. The exposure device 3*a* writes (forms) a latent image for an image on the charged surface of the photosensitive drum 1*a* by scanning of the charged surface through a rotation mirror with a laser beam obtained by ON-OFF modulation of scanning line image data expanded from a separated color image for yellow.

The developing device 4*d* reversely develops the electrostatic image into the toner image by supplying the toner to the photosensitive drum 1*a*.

The primary transfer roller 6*a* urges the intermediary transfer belt 5 to form a primary transfer portion Ta between the photosensitive drum 1*a* and the intermediary transfer belt 5. By applying a DC voltage to the primary transfer roller 6*a*, the toner image carried on the photosensitive drum 1*a* is primary-transferred onto the intermediary transfer belt 5. The drum cleaning device 19*a* rubs the photosensitive drum 1*a* with a cleaning blade to collect transfer residual toner passing through the primary transfer portion Ta and being deposited on the surface of the photosensitive drum 1*a*.

The intermediary transfer belt 5 is supported by being extended around a tension roller 63, an opposite roller 62 and a driving roller 61 and is driven by the driving roller 61, thus being rotated in the direction indicated by an arrow R2. The secondary transfer portion T2 is constituted by bringing a secondary transfer roller 10 into contact with the intermediary transfer belt 5 supported by the opposite roller 62. By applying the DC voltage to the secondary transfer roller 10, the toner image carried on the intermediary transfer belt 5 is secondary-transferred onto the recording material P conveyed into the secondary transfer portion T2. A belt cleaning device 18 rubs the intermediary transfer belt 5 with a cleaning blade, thus collecting the transfer residual toner deposited on the intermediary transfer belt 5.

In recent years, as a demand for the image forming apparatus from the market, that for a color image forming apparatus such as a color copying machine or a color printer is increasing. It is desired that the color image forming apparatus is required to provide an image forming speed comparable to that of a monochromatic image forming apparatus, an image quality comparable to that of offset printing and is required to be downsized.

<Developing Device>

Figure 2:
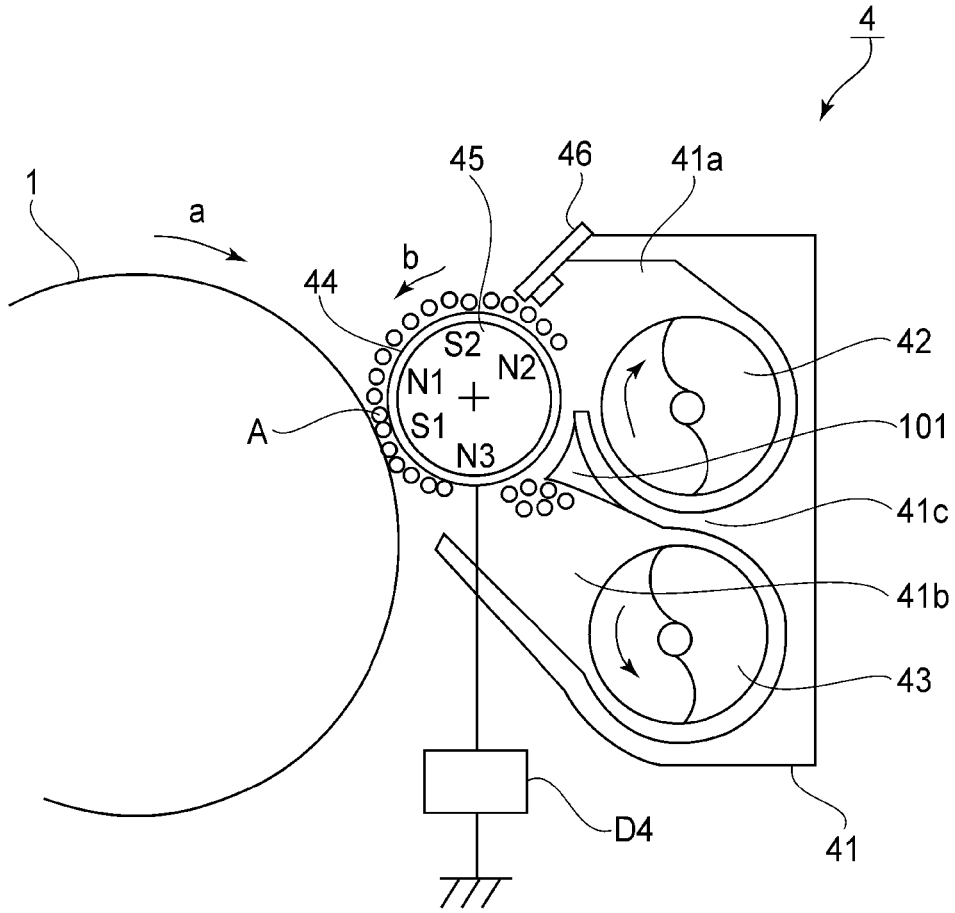
FIG. 2 is an illustration of a structure of a developing device at a cross section perpendicular to an axis of the developing device.
Figure 3:
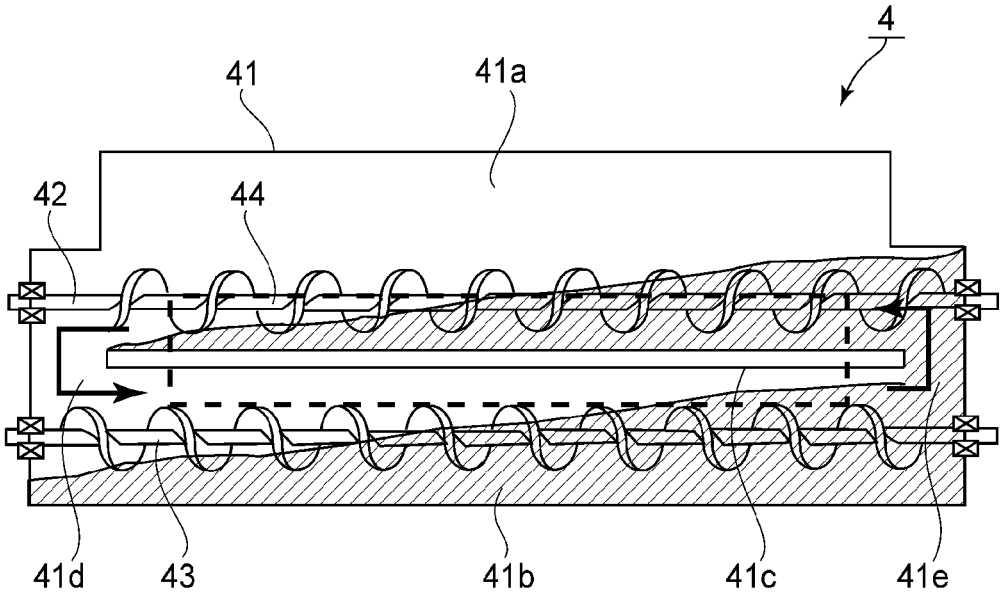
FIG. 3 is an illustration of a structure of the developing device at a longitudinal sectional surface.

FIG. 2 is an illustration of a structure of the developing device at a cross section perpendicular to an axis of the developing device. FIG. 3 is an illustration of a structure of the developing device at a longitudinal sectional surface. In FIGS. 2 and 3, reference numerals or symbols from which the suffixes a, b, c and d for discriminating the image forming portions Pa, Pb, Pc and Pd are added to constituent members (elements), and the constituent members will be described based on the reference numerals or symbols.

As shown in FIG. 2, the developing device 4 uses a two-component developer, as the developer, containing non-magnetic toner particles (toner) and magnetic carrier particles (carrier). In the color image forming apparatus, a magnetic material may be not incorporated in the toner and therefore due to good color or the like, the two-component developer is widely used. The developing device 4 includes a developing container 41 in which the two-component developer containing the toner and the carrier is accommodated as the developer.

The toner contains a binder resin, a colorant, and, as needed, colored particles containing another additive-containing colored resin particles and an external additive such as colloidal silica fine powder externally added to the colored resin particles. The toner is a negatively chargeable polyester-based resin and may preferably have a volume-average particle size of 5 μm or more and 8 μm or less. In this embodiment, the volume-average particle size was 7.0 μm.

Further, as the carrier, it is possible to suitable use, e.g., surface-oxidized or un-oxidized metals such as iron, nickel, cobalt, manganese, chromium, rare-earth elements; alloys of these metals; and oxide ferrite. A manufacturing method of these magnetic particles is not particularly limited. The carrier may have the volume-average particle size of 20-60 μm, preferably 30-50 μm and may have a resistivity of $10^7$ Ωcm or more, preferably $10^8$ Ωcm or more. In this embodiment, the carrier having the volume-average particle size of 40 μm, the resistivity of $5\times10^8$ Ωcm, and a magnetization of 260 emu/ml was used.

As shown in FIG. 3, the developing device 4 is of a function separation type in which a first feeding portion (41*a*) for supplying the developer to a developer carrying member (44) and a second feeding portion (41*b*) for collecting the developer from the developer carrying member (44) are separated from each other. The inside of the developing container 41 is partitioned into an upper-side developing chamber 41*a* and a lower-side stirring chamber 41*b* by a partition wall 41*c* having an intermediate height. The developing chamber 41*a* and the stirring chamber 41*b* vertically communicate with each other at longitudinal end portions to constitute a circulating path. At the longitudinal end portions of the partition wall 41*c*, openings 41*d* and 41 are provided as a delivery portion for permitting passing of the developer between the developing chamber 41*a* and the stirring chamber 41*b*.

In the upper-side developing chamber 41*a*, a developing screw 42 is provided. The developing screw 42 is disposed in parallel to the developing sleeve 44 at a bottom portion of the developing chamber 41*a* along the developing sleeve 44 and is rotated in the clockwise direction along a feeding direction, thus feeding the developer in the developing chamber 41*a* in one direction of an axial direction. In the lower-side stirring chamber 41*b*, a developing screw 43 is provided. The developing screw 43 is disposed in parallel to the developing screw 42 and is rotated in the counterclockwise direction opposite to the rotational direction of the developing screw 42, thus feeding the developer in the developing chamber 41*b* in the direction opposite to the feeding direction in the developing chamber 41*a*.

With the feeding of the developer by the rotation of the developing screw 42, the developer in the developing chamber 41*a* is delivered to the stirring chamber 41*b* through the opening 41*d* of the partition wall 41*c*. With the feeding of the developer by the rotation of the developing screw 43, the developer in the stirring chamber 41*b* is delivered to the developing chamber 41*a* through the opening 41*e* of the partition wall 41*c*. The developing screws 42 and 43 feed the developer while stirring the developer, thus circulating the developer in the developing container 41.

With the feeding of the developer by the rotations of the developing screws 42 and 43, the developer is circulated between the developing chamber 41*a* and the stirring chamber 41*b*. During the circulation, the toner and the carrier rub against each other, thus being charged to the negative and positive polarities, respectively.

As shown in FIG. 2, at an opening provided at a position corresponding to a developing region A in which the developing container 41 opposes the photosensitive drum 1, the developing sleeve 44 is rotatably provided so as to be partly exposed while opposing the photosensitive drum 1. At an upstream position of the exposed developing sleeve 44 with respect to the rotational direction, a developing blade 46 for regulating a length of a magnetic chain of the developer carried on the developing sleeve 44 is provided. A diameter of the developing sleeve 44 is 20 mm, a diameter of the photosensitive drum 1 is 80 mm, and the closest distance between the developing sleeve 44 and the photosensitive drum 1 in the developing region A is 300 μm. The developing sleeve 44 is constituted by a non-magnetic material such as aluminum or stainless steel.

At an inner portion of the developing sleeve 44, a magnet roller 45 is provided in a non-rotational state. The magnetic roller 45 includes a magnetic pole S1 opposing the photosensitive drum 1 in the developing region A and a magnetic pole S2 opposing the developing blade 46. A magnetic pole N1 is disposed between the magnetic poles S1 and S2, a magnetic pole N2 is disposed upstream of the magnetic pole S2 with respect to the rotational direction of the developing sleeve 44, and a magnetic pole N3 is disposed downstream of the magnetic pole S1 with respect to the rotational direction of the developing sleeve 44.

By a magnetic force of the developing pole S1, the magnetic chain of 1000 μm to 1200 μm is formed on the surface of the developing sleeve 44. The opposing distance between the developing sleeve 44 and the photosensitive drum 1 is 300 μm and therefore in the developing region A, an end of the magnetic chain of the developer slides on the photosensitive drum 1 with a length of 500 μm to 900 μm.

The developer passes through a gap between the end of the regulating blade 46 and the developing sleeve 44 and is sent to the developing region A. The regulating blade 46 is a plate-like member constituted by the non-magnetic material such as aluminum and is disposed along the longitudinal direction of the developing sleeve 44. By adjusting the gap between the end of the regulating blade 46 and the developing sleeve 44, a chain cutting amount of the magnetic chain of the developer carried by the developing sleeve 44 is adjusted, so that the amount of the developer fed to the developing region A is set. The gap between the end of the regulating blade 46 is settable at 100-1000 μm, preferably 200-700 μm. In this embodiment, the gap is set at 500 μm, so that the amount per unit area of the developer coated on the developing sleeve 44 is regulated at 30 mg/cm$^2$.

In the developing region A, the developing sleeve 44 rotates in the same direction as that of the photosensitive drum 1 at the opposing surface. A peripheral speed ratio of the developing sleeve 44 to the photosensitive drum 1 is settable between 0.5 and 2.5 and with a larger peripheral speed ratio, a developing efficiency is increased. However, when the peripheral speed ratio is excessively large, there arises a problem of toner scattering, developer deterioration or the like and therefore the peripheral speed ratio is set at 1.0 to 2.0. In this embodiment, the peripheral speed ratio of the developing sleeve 44 to the photosensitive drum 1 is 1.75.

The developing sleeve 44 rotates in an arrow b direction while carrying the developer regulated in layer thickness by the regulating blade 46, and feeds the developer into the developing region A, so that the electrostatic image formed on the photosensitive drum 1 is supplied with the toner and is developed into the toner image.

In this case, a power source D4 applies to the developing sleeve 44 an oscillating voltage in the form of a DC voltage Vdc biased with an AC voltage. In this embodiment, the DC voltage Vdc is −500 V, and the AC voltage has a peak-to-peak voltage of 800 V, a frequency f of 12 kHz and a rectangular waveform. Further, generally, when the AC voltage is superposed, the developing efficiency is increased and thus the image is improved in quality but a white background fog such that the toner is deposited on white background is liable to occur.

For that reason, a fog-removing potential difference (VD−Vdc)=−200 V is provided between the DC voltage Vdc applied to the developing sleeve 44 and the charge potential (white background potential) of the photosensitive drum 1, so that the deposition of the negatively charged toner is prevented. However, these voltage conditions are not limited to combinations of these numerical values.

In the developing device 4 of the function separation type, the amount of the developer present in the stirring chamber 41*b* is increased toward the opening 41*e* where the developer is raised, so that a carry-around phenomenon that the developer in the stirring chamber 41*b* is unintentionally supplied to the developing sleeve 44 and is carried around by the developing sleeve 44. When the carry-around phenomenon occurs, the developer lowered in toner content by consumption of the toner in development is, immediately after being collected into the stirring chamber 41*b*, carried around by the developing sleeve 44 without being sufficiently stirred with the developer in the developing container 41, so that the electrostatic image on the photosensitive drum 1 is developed with the developer. In a state in which the developer lowered in toner content by consumption in development is carried on the developing sleeve 44, the amount of the toner supplied in the developing process of the electrostatic image on the photosensitive drum 1 is insufficient, so that a lowering in image density is conspicuous.

Such a problem becomes a further important problem in a trend of further speed-up of the printer or copying machine using the electrophotographic method in recent years. By the speed-up of the developing sleeve 44, a developer feeding force of the developing sleeve 44 and kinetic energy of the developer cannot be completely suppressed, so that the carry-around of the developer is liable to occur. In the case where a degree of change in developer amount or in agglomeration of the developer is large, the amount in developer present in the stirring chamber 41*b* is increased so that the carry-around phenomenon is less liable to be prevented.

In the following embodiments, the carry-around preventing member 101 is provided on the partition wall 41*c* for partitioning the developing chamber 41*a* and the stirring chamber 41*b* and is subjected to special processing at its developing sleeve opposing surface, so that the speed-up of the developing sleeve 44 is addressed to prevent the carry-around phenomenon of the developer.

<Embodiment 1>

Figure 4:
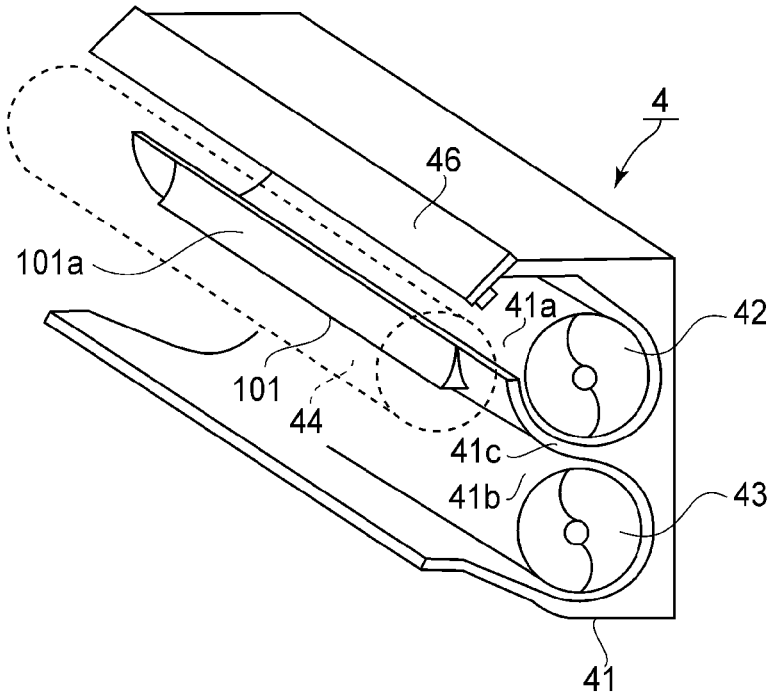
FIG. 4 is a perspective view for illustrating an arrangement of a carry-around preventing member in Embodiment 1.

FIG. 4 is a perspective view for illustrating an arrangement of a carry-around preventing member in Embodiment 1. Parts (a) and (b) of FIG. 5 are illustrations of a structure of the carry-around preventing member in Embodiment 1. FIG. 6 is an illustration of a measuring apparatus of a coefficient of dynamic friction. FIG. 7 is a graph for illustrating the coefficient of dynamic friction.

As shown in FIG. 3, in this embodiment, the developing chamber 41*a* which is an example of the first feeding portion supplies the developer to the developing sleeve 44, which is an example of the developer carrying member, while feeding the developer along the developing sleeve 44. The stirring chamber 41*b* which is an example of the developer carrying member communicates with the developing chamber 41*a* at the longitudinal end portions and feeds the developer in the direction opposite to the feeding direction in the developing chamber 41*a* while collecting the developer from the developing sleeve 44. A surface 101*a* which is an example of an opposing surface opposes the developing sleeve 44 with a spacing to separate the developing chamber 41*a* and the stirring chamber 41*b*.

Through the openings (i.e., the communicating portions) 41*d* and 41*e* provided at the longitudinal end portions of the partition wall 41*c*, the developer is circulated between the developing chamber 41*c* and the stirring chamber 41*b*. With a distance toward the opening 41*e* where the developer is raised, the amount of the developer present in the stirring chamber 41*b* is increased. This is because the developer collected from the developing sleeve 44 is merged with the developer fed by the stirring screw 43 and thus the developer amount is increased at a position closer to a downstream end of the stirring screw 43. As a result, in the neighborhood of the opening 41*e* downstream of the stirring screw 43, the developer surface height became high, so that the developer which had been just collected was increased in proportion thereof supplied to the developing sleeve 44 and therefore a possibility of an occurrence of the carry-around phenomenon was increased.

As shown in FIG. 4, in this embodiment, the carry-around preventing member 101 is disposed in the developing container 41 while being opposed to the developing sleeve 44. The surface 101*a* of the carry-around preventing member 101 is disposed at a position corresponding to the angular position of the magnet roller 45 between the magnetic poles of the same polarity. The gap between the developing sleeve 44 and the surface 101*a* is smaller than the length of the magnetic chain of the developer formed by the magnetic poles on the developing sleeve 44.

As shown in (a) of FIG. 5, inside the developing sleeve 44, the magnet roller 45 which is an example of a magnet member, which includes a plurality of magnetic poles at circumferential angular positions and is disposed non-rotationally is provided. The carry-around preventing member 101 is provided for preventing the developer to move from the N3 pole toward the N2 pole of the magnetic roller 45. Of the full circumference of the developing sleeve 44, at the angular position in which the developer is constrained by the magnetic flux of the magnet roller 45, the developing sleeve 45 has a strong force for carrying and conveying the developer, so that the carry-around phenomenon cannot be prevented. For this reason, the carry-around preventing member 101 is disposed in Gaussian band G which is an angular range in which there is substantially no magnetic force generated by the magnet roller 45.

The developer carried around by the developing sleeve 44 is caught by providing the carry-around preventing member 101, so that the carry-around phenomenon can be prevented even when the developer surface height is increased to some extent. However, the carry-around preventing member 101 cannot achieve the purpose of catching the developer when the developer present on the developing sleeve 44 contacts the carry-around preventing member 101.

Therefore, in a state in which the carry-around preventing member 101 is demounted, an experiment in which the carry-around phenomenon is intentionally caused on the developing sleeve 44 by increasing the developer surface height at the downstream side of the stirring screw 43 was conducted. As a result, it was confirmed that the developer is carried around with a thickness of about 1 mm from the surface of the developing sleeve 44. On the basis of this experiment result, the opposing distance between the carry-around preventing member 101 and the developing sleeve 44 was set at 800 μm, so that the carry-around developer was caught.

However, when a mixing ratio between the toner and the carrier or a toner charge amount is changed by a change in temperature or humidity during an operation of the developing device, a change in bulk density or feeding property of the developer occurs. Further, when the image formation with less toner consumption is effected for a long time, a deterioration of the developer proceeds and an agglomeration degree of the developer is changed, so that the change in bulk density or feeding property of the developer occurs. When such an unintended change in bulk density or feeding property of the developer occurs, the developer surface height at the downstream side of the stirring screw 43 is largely increased, so that the carry-around phenomenon by the developing sleeve 44 cannot be sufficiently prevented only by simply providing the carry-around preventing member 101.

Therefore, in this embodiment, an average diameter of a recessed portion constituting a surface-roughed portion of each of the developer carrying member and the opposing surface is larger than an average particle diameter of the developer. A 10-point average surface roughness of the surface 101*a* of the carry-around preventing member 101 is 4 times or more a 10-point average surface roughness of the developing sleeve 44. For this reason, the surface 101*a* of the carry-around preventing member 101 has a coefficient of dynamic friction, with respect to a surface of a measuring element (gage) 121 on which the developer is fixed, larger than that of the developing sleeve 44.

That is, a surface roughness Ra (μm) the surface 101*a* of the carry-around preventing member 101 opposing the developing sleeve 44 was made larger than the surface roughness Ra (μm) of the developing sleeve 44. Specifically, in this embodiment, the surface roughness Ra (μm) of the surface 101*a* was set by the same method as that for the developing sleeve 44. A blast processing method in which may uneven (projection/recess) portions were provided by blasting abrasive grains, ejected by using compressed air, onto a material surface was employed. In the blast processing method, by adjusting a particle size, a type, a blasting pressure, a blasting time and the like of the abrasive grains, a desired surface roughness can be obtained.

The surface roughness Ra (μm) is defined as the 10-point surface roughness and was measured by using a surface-shape measuring microscope ("VF7500" or "VF7510", mfd. by KEYENCE Corp.) and an objective lens (magnification: 250 to 1250). The surface-shape measuring microscope is an apparatus capable of observing a micro-shape of each of the surface 101*a* of the carry-around preventing member 101 and the surface of the developing sleeve 44 and capable of measuring the surface roughness Ra in a non-contact manner.

Further, as shown in FIG. 6, a frictional force measuring apparatus 120 (available from Canon K.K.) was used as a measuring apparatus and was used for measuring the coefficient of dynamic friction of the carry-around preventing member 101 and the developing sleeve 44 to compare measured values. To the frictional force measuring apparatus 120, an interface (mfd. by Nikkaki K.K.) for outputting a state frictional force and a dynamic frictional force was connected and the apparatus 120 was controlled by a personal computer.

Onto the measuring element (paper) 121, a double-side tape was applied and then the developer was placed on one surface of the double-side tape and was knocked off, so that a developer layer 125 of a single layer of the fixed developer was formed on the measuring element 121 via the double-side tape 124. The measuring element 121 is fixed to the apparatus body via a load cell (stress measuring element) 126. In a state in which a uniform pressure (16.7 g/cm$^2$ (total pressure: 1000 g)) was applied to the measuring element 121 via slime (viscoelastic material) 122 by a weight 123, a measuring object (101 or 44) was slowly moved at a certain speed to measure a strain/stress characteristic.

As shown in FIG. 6, in a state in which the measuring element 121 is urged toward the measuring object (101, 44), which is intended to be measured, and is fixed by the weight 123, when the measuring object (101, 44) is pulled at the certain speed, an output diagram of the load cell 126 is obtained. As shown in FIG. 7, a rising maximum of the output of the load cell 126 is the static frictional force and an average of output values in an output stable area after the rising maximum is the dynamic frictional force.

In Embodiment 1, the developing sleeve 44 was subjected to the blast processing (blasting) in which glass beads (average particle size: 80 μm) larger than the average particle size of the carrier were blasted onto the circumferential surface of an aluminum pipe at a constant pressure, so that the surface roughness Ra was set at 2.5 μm. The carry-around preventing member 101 was prepared by ejection molding of polycarbonate AS resin (PCAS) which is a general resin material and then was subjected to the blast processing under a different condition, so that the surface roughness Ra was set at 10 μm. The coefficient of dynamic friction between the carry-around preventing member 101 having the surface roughness Ra of 10 μm and the measuring element 121 via the developer layer 125 was 0.35, and the coefficient of dynamic friction between the developing sleeve 44 having the surface roughness Ra of 2.5 μm and the measuring element 121 via the developer layer 125 was 0.25.

Then, the carry-around preventing member 101 having the surface roughness Ra of 10 μm at its surface 101*a* and the developing sleeve 44 having the surface roughness Ra of 2.5 μm were mounted in the developing device 4 and then the presence or absence of the occurrence of the carry-around phenomenon was checked under a severe condition in which the surface of the developer present in the stirring chamber 41*b* was contacted to the developing sleeve 44. As a result, the carry-around phenomenon did not occur at all.

In this embodiment, the surface roughness Ra (μm) of the surface 101*a* of the carry-around preventing member 101 was larger than the surface roughness (μm) of the surface of the developing sleeve 44. As a result, the coefficient of dynamic friction between the developer and the surface 101*a* was larger than the coefficient of dynamic friction between the developer and the developing sleeve 44. Thus, a force of constraint per unit area with respect to the developer present between the developing sleeve 44 and the surface 101*a* of the carry-around preventing member 101 was larger at the surface 101*a* of the carry-around preventing member 101 than at the surface of the developing sleeve 44.

According to an observation, in the case where the developer entered between the carry-around preventing member 101 and the developing sleeve 44, a proportion at which the developer was braked and constrained by the surface 101*a* of the carry-around preventing member 101 was higher than a proportion at which the developer passed through the gap between the carry-around preventing member surface 101*a* and the developing sleeve 44 without stopping by the rotation of the developing sleeve 44. The developer was braked by the surface 101*a* of the carry-around preventing member 101 and was stably stagnated in a narrow area (2 mm) at an entrance side of the opposing spacing between the carry-around preventing member 101 and the developing sleeve 44.

By the developer layer formed at the entrance side of the opposing spacing between the carry-around preventing member 101 and the developing sleeve 44, the developer carried around by the developing sleeve 44 was effectively scraped off, so that the developer could not enter the opposing spacing between the carry-around preventing member 101 and the developing sleeve 44. As a result, it was possible to prevent the carry-around phenomenon of the developer. Correspondingly, it was possible to prevent non-uniformity of and temporary lowering in image density due to non-uniformity of the toner content which was problematic during the occurrence of the carry-around phenomenon.

In this embodiment, the carry-around preventing member 101 has the opposing surface 101*a*, opposing the developing sleeve 44, which has the surface roughness larger than that of the developing sleeve 44, so that the developer carry-around phenomenon by the developing sleeve 44 can be prevented to suppress the non-uniformity of the image density. Further, as described above, the carry-around 101 is disposed in the Gaussian band G and therefore it becomes possible to control the carry-around phenomenon only on the basis of the relationship of the surface roughness Ra (μm) between the surface 101*a* of the carry-around preventing member 101 and the developing sleeve 44.

Incidentally, the present invention is not limited to the above-described material of the photosensitive drum, the developer, the structure of the image forming apparatus, and the like. As the surface roughness Ra setting method, the metal mold for the ejection molding of the carry-around preventing member 101 may also be provided with minute unevenness which is directly transferred onto the surface 101*a*. The present invention is not limited to this embodiment in which a uniform surface roughness Ra is set with respect to a crossing direction of the surface 101*a* but an area in which a thin stripe-like portion extending in the longitudinal direction and having a large surface roughness Ra may also be formed at a position corresponding to the position in which the stagnated layer of the developer is intended to be formed. The surface roughness of the surface other than the surface 101*a* of the carry-around preventing member 101 may also be changed.

The present invention is applicable to various developers and image forming apparatuses. Specifically, the color of the toner, the number of colors of the toner, the presence or absence of the wax, the order of development for the respective color toner images, the number of each of the developing screw and the stirring screw, the surface roughness of the carry-around preventing member 101, and the like are not limited to the above-described numerical values or the like. With respect to the structure of the developing device, the arrangement of the developing chamber 41*a* and the stirring chamber 41*b* is not limited to the vertical arrangement but may also be the horizontal arrangement. The present invention can also be carried cut in other embodiments of the developing device.

<Embodiment 2>

FIG. 8 is an illustration of a structure of a carry-around preventing member in Embodiment 2. In this embodiment, the arrangement, the dimension and the material are the same as those in Embodiment 1. Only a blast processing pattern at the opposing surface of the carry-around preventing member opposing the developing sleeve is different. For this reason, the structure common to Embodiments 1 and 2 will be omitted from redundant description and the blast processing pattern of the developing sleeve opposing surface of the carry-around preventing member in this embodiment will be described.

Embodiment 2 relates to the blast processing pattern of the developing sleeve opposing surface of the carry-around preventing member for preventing the carry-around phenomenon with reliability even in the case where there is a difference in developer surface height with respect to the longitudinal direction of the developing device of the function separation type. In this embodiment, the surface roughness of the surface 101*a* of the carry-around preventing member 101 at the upstream portion of the stirring chamber 41*b* is different from that at the downstream portion of the stirring chamber 41*b*. Specifically, the surface roughness of the surface 101*a* of the carry-around preventing member 101 at the downstream portion of the stirring chamber 41*b* is larger than that at the upstream portion of the stirring chamber 41*b*.

As shown in FIG. 3, the developer is circulated between the developing chamber 41*a* and the stirring chamber 41*b* through the openings (communicating portions) 41*d* and 41*e* provided at the longitudinal end portions of the partition wall 41*c* and is increased in amount thereof present in the stirring chamber 41*c* with a distance closer to the opening 41*e* where the developer is raised. As a result, in the neighborhood of the downstream opening 41*e* of the stirring screw 43, the developer surface height is increased compared with that in the neighborhood of the upstream opening 41*d*, so that the developer carry-around phenomenon is liable to occur in the neighborhood of the opening 41*e* of the stirring screw 43 more than in the neighborhood of the opening 41*d*.

Therefore, as shown in FIG. 8, in this embodiment, the surface roughness of the preventing member carry-around 101 opposing the developing sleeve 44 is made different with respect to the longitudinal direction, so that a develop carry-around phenomenon preventing performance in the neighborhood of the opening 41*e* of the stirring screw 43 is made higher than that in the neighborhood of the opening 41*d*. Specifically, the surface roughness Ra of the carry-around preventing member 101 opposing the developing sleeve 44 at the communicating portion 41*d* where the developer surface height is lowest with respect to the longitudinal direction was 5 μm. Further, the surface roughness Ra of the carry-around preventing member 101 opposing the developing sleeve 44 at the communicating portion 41*e* where the developer surface height is highest was 15 μm. However, a degree of change, an absolute value and the like of the surface roughness with respect to the longitudinal direction of the carry-around preventing member 101 are not limited to the numerical values described above, The surface roughness Ra of the developing sleeve 44 was 2.5 μm similarly as in Embodiment 1. Therefore, the 10-point average surface roughness of the surface 101*a* is 2 times or more and 6 times or less the 10-point average surface roughness of the developing sleeve 44.

As in Embodiment 1, in the case where the surface roughness Ra of the surface 101*a* of the carry-around preventing member 101 is constant with respect to the longitudinal direction, when the developing device 4 is operated, at the entrance side of the opposing spacing between the developing sleeve 44 and the surface 101*a*, the developer stagnated layer is formed over the full area with respect to the longitudinal direction. For this reason, even in the longitudinal upstream area in which the developer surface height is low and the carry-around phenomenon of the developer by the developing sleeve 44 does not occur, a state in which the developing sleeve 44 is rotated relative to the surface 101*a* while interposing the developer therebetween is formed.

On the other hand, in Embodiment 2, in the longitudinal upstream area in which the carry-around phenomenon of the developer by the developing sleeve 44 does not occur, the surface roughness Ra of the surface 101*a* is low and therefore an unnecessary developer layer is less liable to be formed and is liable to disappear even when the layer is formed. For this reason, the developing sleeve 44 is less liable to be rotated relative to the surface 101*a* while interposing the developer therebetween.

<Embodiment 3>

FIG. 9 is an illustration of a surface state of a developing sleeve in Embodiment 3. In this embodiment, the developing sleeve 44 is provided with groove structures as the uneven surface structure, so that a long lifetime of the developing device 4 is realized. Other constituent elements including the carry-around preventing member 101 are the same as those in Embodiment 1 and therefore will be omitted from redundant description.

In Embodiment 1, the uneven surface structure of the developing sleeve 44 was formed by the blast processing method in which many uneven portions are provided by blasting abrasive grains onto the surface of the developing sleeve 44 at a constant pressure. The developer feeding property is ensured by the uneven surface structure provided by the blast processing method, so that the developer is fed to the developing region A opposing the photosensitive drum 1 to develop the electrostatic image into the toner image on the photosensitive drum 1.

However, the uneven surface structure provided by the blast processing method is gradually abraded by sliding with the developer with cumulative image formation, so that a developer carrying performance of the developing sleeve 44 is lowered and thus the developer coating amount per unit area is decreased. As a result, the toner supply amount is insufficient, so that a maximum density of the image is lowered.

For that reason, the developing device 4 has been replaced with a new one in such a manner that a cumulative operating time of the developing device 4 is controlled and is judged that the developing device 4 reaches the end of its lifetime before the cumulative operating time reaches the time when the lowering in output image density occurs. Therefore, it can be said that a degree of surface abrasion of the developing sleeve 44 determines the lifetime of the developing device 4.

Therefore, as an alternative means of the blast processing method for forming the uneven surface structure to ensure the feeding property, a grooved developing sleeve provided with grooves over the entire longitudinal area by knurling so that the feeding force is present with respect to the rotational direction of the developing sleeve 44 has been put into practical use.

As shown in FIG. 9, the developing sleeve 44 is provided with periodical grooves 41*m* having a depth larger than that of the uneven surface structure provided by the blast processing method, so that the developer feeding property is ensured by the grooves 41*m*. For this reason, the developer caught by the grooves little slip on the surface of the developing sleeve 44 and therefore the surface of the developing sleeve 44 is little abraded. As a result, even when the operating time reaches the cumulative operating time for exceeding a durability lifetime of the conventional developing device, the lowering in feeding property of the developing sleeve 44 does not occur, so that a lifetime extension of the developing device 4 is achieved.

In Embodiment 3, groove structures are formed at the developing sleeve opposing surface of the carry-around preventing member 101 over the entire longitudinal area. The groove structures may only be required that grooves are disposed so that the feeding force is present with respect to the rotational direction of the developing sleeve. Specifically, the groove structures may be formed in parallel to the longitudinal direction or may be formed obliquely to the longitudinal direction or in a grid-like shape.

As shown in FIG. 6, when the coefficient of dynamic friction with respect to the measuring element 121 on which the developer is fixed is measured by using the frictional force measuring apparatus 120, the coefficient of dynamic friction of the surface 101*a* of the carry-around preventing member 101 was higher than that of the grooved developing sleeve 44. In the case where the coefficient of dynamic friction is set at a high level, when the groove structures have the same depth, it would be considered that the number of grooves per unit length at the surface 101*a* is made larger than that of the developing sleeve 44. Further, when the number of grooves per unit area is the same, it would be considered that the depth of the groove structures at the surface 101*a* is made deeper than that of the developing sleeve 44. However, when the coefficient of dynamic friction of the developing sleeve opposing surface of the carry-around preventing member 101 is higher than that of the developing sleeve 44, there is of no problem even in the case where the developing sleeve opposing surface of the carry-around preventing member 101 is provided with many uneven portions formed by the blast processing method.

In Embodiment 3, the surface 101*a* of the carry-around preventing member 101 was provided with the groove structure, deeper than that of the developing sleeve 44, in the same pattern. A constitution in which the groove structures of the developing sleeve 44 and the developing sleeve opposing surface of the carry-around preventing member 101 are tilted within ±5 degrees with respect to a generating line of the developing sleeve 44 and are obliquely crossed and opposed to each other. By increasing the coefficient of dynamic friction, the developer feeding performance of the surface 101*a* of the carry-around preventing member 101 is made higher than that of the developing sleeve 44, so that the amount of the developer carried around by the developing sleeve is decreased with reliability similarly as in Embodiment 1.

Further, the developer carry-around phenomenon is prevented by a roughening the surface of the carry-around preventing member 101 and therefore the entering developer is trapped by the carry-around preventing member 101 and is not moved. The carry-around preventing member 101 is, different from the developing sleeve 44, not rotated and is a stationary member and therefore sliding with the developer little occurs, so that the surface abrasion of the developing sleeve 44 little occurs. For this reason, even in the case where the groove structures are formed over the entire longitudinal area for the purpose of increasing the lifetime of the developing device 4, it was possible to prevent the carry-around phenomenon of the developer by the developing sleeve 44.

<Embodiment 4>

FIG. 10 is an illustration of a structure of a developing device at a cross section perpendicular to an axis of the developing device in Embodiment 4. Parts (a) and (b) of FIG. 11 are illustrations of a structure of a carry-around preventing member 101 in Embodiment 4. In this embodiment, an example in which the carry-around preventing member 101 similar that in Embodiment 1 is mounted in a developing device of a double-sleeve type including two developer carrying members will be described.

As shown in FIG. 10, in the developing device 4 in this embodiment, a developing sleeve 44*b* which is an example of a second developer carrying member carries the developer delivered from a developing sleeve 44*a* which is an example of a first developer carrying member.

The developing chamber 41*a* which is an example of the first feeding portion supplies the developer to the developing sleeve 44*b*, which is an example of the developer carrying member, while feeding the developer along the developing sleeve 44*a*. The stirring chamber 41*b* which is an example of the developer carrying member communicates with the developing chamber 41*a* at the longitudinal end portions and feeds the developer in the direction opposite to the feeding direction in the developing chamber 41*a* while collecting the developer from the developing sleeve 44. A surface 101*a* which is an example of a first opposing surface opposes the developing sleeve 44*a* with a spacing. A surface 101*b* which is an example of a second opposing surface opposes the developing sleeve 44*b* with a spacing to separate the developing chamber 41*a* and the stirring chamber 41*b* while being connected to the surface 101*a*. The surface roughness of the surface 101*a* is larger than that of the developing sleeve 44*a*, and the surface roughness of the surface 101*b* is larger than that of the developing sleeve 44*b*.

The developing device of the double-sleeve type relates to a system employing a multi-stage developing method and uses a plurality of developing sleeves to increase an opportunity of the development, so that a predetermined image density is ensured. Specifically, in this embodiment, the two developing sleeves 44*a* and 44*b* are used. The developing device 4 includes the developing container 41 in which the two-component developer, as the developer, containing the toner and the carrier is accommodated. Further, in the developing container 41, the developing sleeves 44*a* and 44*b* are disposed in parallel and are rotated in the counterclockwise direction during the development. The flow of the developer in the neighborhood of the carry-around preventing member 101 in the developing container 41 at the opposite side of the developing sleeves 44*a* and 44*b* from the photosensitive drum 1 was described above and thus will be omitted.

The regulating blade 46 regulates the layer thickness of the developer carried on the developing sleeve 44*a*. The chain of the developer is cut by the regulating blade 46 and the regulated developer is fed to a first developing region A1 opposing the photosensitive drum 1, so that the magnetic brush of the developer is formed to supply the toner to the electrostatic image, thus developing the electrostatic image into the toner image on the photosensitive drum 1. Thereafter, the developer delivered from the first developing sleeve 44*a* to the second developing sleeve 44*b* is fed to a second developing region A2, so that the magnetic brush of the developer is formed again to supply the toner to the electrostatic image, thus developing the electrostatic image into the toner image. Thereafter, the developer containing the toner which contributes to the development two times and is consumed in collected from the developing sleeve 44*b* into the stirring chamber 41*b*.

Conventionally, in the developing device 4 using the two developing sleeves, when the developer surface height is increased excessively, on the developing sleeve 44*b* on which the developer is not regulated by the regulating blade 46, there arose a problem that the coating amount becomes for larger than a proper value. Further, there arose a problem that the developer collected from the developing sleeve 44*b* into the stirring chamber 41*b* is carried around by the developing sleeve 44*b* and is merged with the developer delivered from the developing sleeve 44*a* to the developing sleeve 44*b* and thus the excessive developer is carried on the developing sleeve 44*b*. As a result, a problem such that the amount of the toner scattered from the developing sleeve 44*b* is increased or the developing quality is lowered occurred.

In Embodiment 1, the single developing sleeve 44 is urged and therefore even when the developer carry-around phenomenon occurs, the layer thickness of the developer is regulated by the cleaning blade, so that the toner content is lowered and thus the image density can be decreased but there is no another problem. On the other hand, in the case of the two developing sleeves 44*a* and 44*b*, there is no regulating blade on the downstream developing sleeve 44*b* with respect to the feeding direction of the developer and therefore the developer layer thickness cannot be regulated. When the carry-around phenomenon occurs on the developing sleeve 44*b*, the developer in the amount which is the sum of the amount of the developer delivered from the developing sleeve 44*a* and the amount of the developer which is carried around is coated on the developing sleeve 44*b*. For example, when the coating amount per unit area of the developer on the developing sleeve 44*a* is 30 mg/cm$^2$ and the amount of the developer carried around is 30 mg/cm$^2$, the coating amount of the developer on the developing sleeve 44*b* is, as a result, 60 mg/cm$^2$ which is two times the proper amount of 30 mg/cm$^2$. For this reason, when the carry-around phenomenon occurs, not only the lowering in image density but also white background fog such that the toner is deposited on the white background and the toner scattering from the developing sleeve 44*b* are liable to occur.

As shown in (a) of FIG. 11, in this embodiment, the carry-around preventing member 101 is provided so that opposing surfaces 101*a* and 101*b* are formed in zero Gaussian bands Ga and Gb on the two developing sleeves 44*a* and 44*b*. By disposing the carry-around preventing member 101 at a position in which the developer carried around by the downstream developing sleeve 44*b* strikes against the carry-around member 101, a proportion of the developer collected from the developing sleeve 44*b* into the stirring chamber 41*b* is carried around by the developing sleeve 44*b* is lowered. By disposing the carry-around preventing member 101, the developer carried around by the developing sleeve 44*b* is prevented from entering the opposing portions opposing the developing sleeves 44*a* and 44*b*, so that the developer is less liable to be coated again on the developing sleeve 44*b*.

However, in the case where the rotational speed of the developing sleeve 44*b* is enhanced, the developer feeding force of the developing sleeve 44*b* and kinetic energy of the developer cannot be completely suppressed, so that there is a possibility that the developer carry-around phenomenon cannot be sufficiently prevented. In the case where the change in amount of the developer in the developing container 41 or the change in toner agglomeration of the developer is large, there is a possibility that the developer surface height is excessively increased at the downstream side of the stirring chamber 41*b* and thus an area in which the entering of the developer cannot be sufficiently prevented by the preventing force of the carry-around preventing member 101. As a result, there is a possibility that the proportion of the developer collected into the stirring chamber 41*b* and then coated again on the developing sleeve 44*b* becomes high.

Therefore, as shown in (b) of FIG. 11, values of the surface roughness Ra (μm) of the surfaces 101*a* and 101*b* of the carry-around preventing member 101 opposing the developing sleeves 44*a* and 44*b* are made larger than those of the surface roughness Ra (μm) of the developing sleeves 44*a* and 44*b*. As a result, the amount of the developer carried around by the developing sleeves 44*a* and 44*b*, particularly by the downstream developing sleeve 44*b* is decreased. The surface roughness Ra (μm) of the surface 101*b* of the carry-around preventing member 101 is made higher than the surface roughness Ra (μm) of the developing sleeve 44*b*, so that the amount of the developer carried around by the developing sleeve 44*b* is decreased. By increasing the surface roughness Ra (μm) of the surface 101*b*, the developer catching effect of the carry-around preventing member 101 is enhanced, so that there is substantially no developer which enters the opposing portions opposing the developing sleeves 44*a* and 44*b* and is coated again on the developing sleeve 44*b*. As a result, the coating amount of the developer on the developing sleeve 44*b* is kept at a proper value, so that it was possible to solve the problem of the case where the two developing sleeves 44*a* and 44*b* are used. Problems, occurring when the developer is carried around, such as image non-uniformity, white background fog image, and the toner scattering from the developing sleeve 44*b* are also solved.

In Embodiment 4, the surface roughness Ra of the carry-around preventing member 101 is 10 μm, and the surface roughness Ra of the developing sleeves 44*a* and 44*b* is 2.5 μm. As a result of the measurement by using the above-described frictional force measuring apparatus 120, the coefficient of dynamic friction between the developer and the carry-around preventing member 101 is 0.35, and the coefficient of dynamic friction between the developing sleeve 44 and the developer is 0.25.

Then, the above-described processed developing sleeves 44*a* and 44*b* and the carry-around preventing member 101 were mounted in the developing device 4 and a severe condition in which the surface of the developer present in the stirring chamber 41*b* was contacted to the developing sleeve 44 was set, and then the presence or absence of the occurrence of the carry-around phenomenon was checked. As a result, the carry-around phenomenon did not occur at all.

<Toner Agglomeration>

In the above-described embodiments, from the viewpoint of prevention of the developer carry-around phenomenon by the developing sleeve, the surface roughness Ra (μm) of the developing sleeve opposing surface of the carry-around preventing member 101 was increased. However, according to an experimental observation, it was also confirmed that a degree of an occurrence of toner agglomeration (aggregate) is decreased by increasing the surface roughness Ra (μm) of the developing sleeve opposing surface of the carry-around preventing member 101.

As shown in FIG. 2, in the case where the surface roughness Ra of the developing sleeve opposing surface of the carry-around preventing member 101 is small, the developer enters the opposing spacing between the carry-around preventing member 101 and the developing sleeve and thus an unstable developer layer is liable to be formed. At an upstream side of the stirring screw 43, the developer surface height is low and therefore the developer is less liable to be supplied between the carry-around preventing member 101 and the developing sleeve 44, so that the developer present in the opposing spacing between the carry-around preventing member 101 and the developing sleeve 44 is less liable to be replaced. When the developer is less replaced, the developer between the carry-around preventing member 101 and the developing sleeve 44 is liable to be formed in an immobile layer, so that when friction is caused at a boundary between the immobile layer and the fluidized layer, the toner is liberated from the carrier to generate toner agglomeration. The toner agglomeration is, when grows into that of a size to some extent, carried around by the developing sleeve 44 to be conveyed to the developing region G and prevents normal development, thus causing an image defect such as density non-uniformity or image stripe in some cases.

For that reason, as shown in FIG. 2, the degree of the occurrence of the toner agglomeration can be reduced by changing the surface roughness of the carry-around preventing member 101 depending on the developer surface height while making the surface roughness of the carry-around preventing member 101 larger than the surface roughness of the developing sleeve 44. In a range from the upstream side to the downstream side in the stirring chamber in which the developer surface height is low and thus the developer carry-around phenomenon is not readily caused, the surface roughness Ra of the surface 101*a* of the carry-around preventing member 101 is decreased, so that the developer between the carry-around preventing member 101 and the developing sleeve 44 is not readily formed in the immobile layer. Thus, in the developing device 4 of the function separation type, the toner agglomeration was less liable to occur. By preventing the occurrence of the toner agglomeration, the occurrence of the density non-uniformity and the image stripe of the output image are prevented.

Further, as shown in FIG. 10, in the developing device 4 including the two developing sleeve 44*a* and 44*b*, the developer between the carry-around preventing member 101 and the developing sleeve 44*b* is liable to stagnate to form the immobile layer. When the immobile layer is formed in the opposing spacing between the carry-around preventing member 101 and the developing sleeve 44, there is a possibility that the toner agglomeration is generated by liberation of the toner from the carrier at the boundary portion between the immobile layer and the fluidized layer. At a stage in which the toner agglomeration has grown, when the toner agglomeration is carried and conveyed to the developing region A2 by the developing sleeve 44*b*, unnecessary to the developing region A2 by the developing sleeve 44*b*, unnecessary spot and image stripe are formed on the image to lower the image quality.

Further, between the developing sleeve 44*a* and the carry-around preventing member 101, when the developer is supplied from the developing screw 42 to the developing sleeve 44*a*, the developer which is not constrained by the developing sleeve 44*a* drops and enters. Further, the developer fed from below toward above by the developing sleeve 44*a* is covered with the dropped developer without being constrained by the developing sleeve 44*a*, thus being continuously stagnated and stirred in the opposing spacing between the developing sleeve 44*a* and the carry-around preventing member 101. For this reason, in the opposing spacing between the developing sleeve 44*a* and the carry-around preventing member 101, the toner agglomeration is liable to occur and at the stage in which the toner agglomeration has grown, the toner agglomeration is moved to the developing container 41 by the developing sleeve 44*a* in some cases. When the toner agglomeration which is prevented from friction with the carrier to have an insufficient charge amount is circulated in the developing container 41, there is an increasing possibility that the image defect occurs.

On the other hand, in the opposing spacing between the downstream developing sleeve 44*b* and the carry-around preventing member 101, the developer is frequently supplied from the stirring screw 43 and therefore the developer is replaced more than in the opposing spacing between the upstream developing sleeve 44*a* and the carry-around preventing member 101. For this reason, compared with the opposing spacing between the upstream developing sleeve 44*a* and the carry-around preventing member 101, the possibility that the toner agglomeration grows is not high.

Therefore, as shown in (b) of FIG. 11, in Embodiment 4, the degree of the develop carry-around phenomenon was decreased by increasing the surface roughness Ra of the surface 101*a* of the carry-around preventing member 101 so as to be larger than the surface roughness Ra of the developing sleeve 44. By increasing the surface roughness Ra of the surface 101*a* of the carry-around preventing member 101, there is substantially no developer which drops on and enters the opposing portion between the carry-around preventing member 101 and the developing sleeve 44*a*, so that the toner is not collected to the extent that the toner agglomeration grows.

In Embodiment 4, the surface roughness Ra of the developing sleeve 44*a* opposing surface of the carry-around preventing member 101 was made larger than that of the developing sleeve 44*a*. As a result, in the case where the developer enters between the carry-around preventing member 101 and the developing sleeve 44*a*, the coefficient of dynamic friction between the developer and the carry-around preventing member 101 is larger than that between the developer and the developing sleeve 44*a*, so that the movement of the developer can be limited. As a result, the developer carry-around phenomenon and the occurrence of the toner agglomeration can be prevented.

In Embodiment 4, the surface roughness Ra of the developing sleeve 44*b* opposing surface of the carry-around preventing member 101 was made larger than that of the developing sleeve 44*b*. As a result, in the case where the developer enters between the carry-around preventing member 101 and the developing sleeve 44*b*, the coefficient of dynamic friction between the developer and the carry-around preventing member 101 is larger than that between the developer and the developing sleeve 44*b*, so that the movement of the developer can be limited. As a result, the developer carry-around phenomenon and the occurrence of the toner agglomeration can be prevented.

As a result, the problem of the toner agglomeration is solved while solving the problem in the case where the two developing sleeves 44*a* and 44*b* are used. The problems, resulting from the developer carry-around phenomenon, such as the image density non-uniformity, the white background fog image, and the toner scattering from the developing sleeve 44*b* are solved and at the same time, the problem of the image defect resulting from the toner agglomeration is also solved.

In the developing device of the present invention, the surface roughness of the opposing surface is large, so that the developer entering the spacing between the developer carrying member and the opposing surface with the rotation of the developer carrying member is braked and thus is less liable to pass through the spacing without stopping. By the braking and stagnation of the developer in the entrance region of the spacing, a subsequent developer carried about by the developer carrying member cannot enter the spacing, so that the developer is separated from the developer carrying member and then is collected into the second feeding portion.

Further, compared with the developer carrying member increased in surface roughness for originally efficiently carry the developer, the surface roughness is further increased and therefore compared with the amount of the developer carried around by the developer carrying member in the spacing entrance region, the stagnation amount of the developer can be increased. For that reason, the developer carried around by the developer carrying member is further reduced in amount.

Therefore, even when the diameter of the developer carrying member is decreased and even when the peripheral speed of the developer carrying member is increased, it is possible to effectively prevent the carry-around phenomenon of the developer collected in the second feeding portion with the rotation of the developer carrying member.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 152831/2011 filed Jul. 11, 2011, which is hereby incorporated by reference.

What is claimed is:

1. A developing device comprising:

a developer carrying member for carrying a developer;

a first feeding portion for supplying the developer to said developer carrying member while feeding the developer along said developer carrying member;

a second feeding portion, communicating with said first feeding portion at end portions thereof, for feeding the developer in a direction opposite to a developer feeding direction of said first feeding portion while collecting the developer from said developer carrying member; and a partition wall portion for partitioning said first and second feeding portions, wherein said partition wall portion includes an opposing portion opposing said developer carrying member with a spacing, and wherein a surface roughness of at least the opposing portion is larger than a surface roughness of said developer carrying member.

2. A device according to claim 1, wherein said developer carrying member includes a magnetic member provided non-rotationally so that magnetic poles thereof are disposed at a plurality of angular positions with respect to a circumferential direction of said developer carrying member, wherein the magnetic member has the magnetic poles including at least magnetic poles of a same polarity arranged in the circumferential direction of said developer carrying member, and wherein the opposing portion opposes said developer carrying member at a position corresponding to an angular position between the magnetic poles of the same polarity.

3. A device according to claim 1, wherein the spacing is shorter than a length of a magnetic chain of the developer formed on said developer carrying member by the magnetic poles.

4. A device according to claim 1, wherein the opposing portion has a coefficient of dynamic friction, with respect to a developer fixed surface, which is larger than a coefficient of dynamic friction of said developer carrying member.

5. A device according to claim 1, wherein an average diameter of a recessed portion constituting a surface-roughed portion of each of said developer carrying member and the opposing portion is larger than an average particle diameter of the developer, and wherein a 10-point average surface roughness of the opposing portion is 2 times or more and 6 times or less a 10-point average surface roughness of said developer carrying member.

6. A device according to claim 1, wherein the opposing portion has an opposing surface upstream of said second feeding portion and an opposing surface, downstream of said second feeding portion, having a surface roughness larger than a surface roughness of the opposing surface upstream of said second feeding portion.

7. A developing device comprising:

a first developer carrying member for carrying a developer to develop a latent image formed on an image bearing member;

a second developer carrying member for carrying the developer, delivered from said first developer carrying member, to develop the latent image formed on the image bearing member;

a first feeding portion for supplying the developer to said first developer carrying member while feeding the developer along said first developer carrying member;

a second feeding portion, communicating with said first feeding portion at end portions thereof, for feeding the developer in a direction opposite to a developer feeding direction of said first feeding portion while collecting the developer from said second developer carrying member;

a partition wall portion for partitioning said first and second feeding portions;

a first opposing portion, provided on said partition wall portion, opposing said first developer carrying member with a spacing; and a second opposing portion, provided on said partition wall portion, opposing said second developer carrying member with a spacing, wherein a surface roughness of said first opposing portion is larger than a surface roughness of said first developer carrying member, and a surface roughness of said second opposing portion is larger than a surface roughness of said second developer carrying member.

* * * * *